US008121464B1

(12) United States Patent
Friedheim

(10) Patent No.: US 8,121,464 B1
(45) Date of Patent: Feb. 21, 2012

(54) SUPERHEATED VAPOR GENERATOR SYSTEM AND METHOD

(76) Inventor: Max Friedheim, Chula Vista, CA (US)

( * ) Notice: Subject to any disclaimer, the term of this patent is extended or adjusted under 35 U.S.C. 154(b) by 590 days.

(21) Appl. No.: 10/066,281

(22) Filed: Feb. 1, 2002

(51) Int. Cl.
*F22B 1/28* (2006.01)
*F22B 13/12* (2006.01)

(52) U.S. Cl. ..... 392/399; 122/460

(58) Field of Classification Search ..... 392/386, 392/387, 394, 396–406; 122/476, 40, 460, 122/461; 239/266, 267, 536, 537, 538
See application file for complete search history.

(56) References Cited

U.S. PATENT DOCUMENTS 2,683,626 A * 7/1954 Wahlin ..... 239/536
3,863,841 A * 2/1975 Berthoud ..... 239/266
4,414,037 A * 11/1983 Friedheim ..... 134/35
5,471,556 A * 11/1995 Friedheim ..... 392/399
6,393,212 B1 * 5/2002 Hutchinson ..... 392/491
* cited by examiner

*Primary Examiner* — Sang Paik
(74) *Attorney, Agent, or Firm* — Evanns & Walsy; Joseph R. Evanns

(57) ABSTRACT

An improved vapor generator and control system includes a vaporization chamber for generating superheated vapor from liquid therein and at least one input connectable to liquid supply and adjustable control for controlling input of liquid into the vaporization chamber whereby output of superheated vapor is controllable while the system is in operation. A method for fabricating vapor generators includes the steps of providing at least two separate parts of a vapor generator, fastening the parts together to form a vapor generator defining a vaporization chamber and providing a capability to connect input control for control of input of liquid to the vaporization chamber. A method for cleaning selected objects comprises the steps of generating superheated vapor and controlling output of superheated vapor terms of volume and/or pressure and/or direction by adjustably controlling in an ongoing manner volume, pressure, and velocity of the liquid being subjected to vaporization. A method of propulsion comprises the steps of generating superheated vapor and adjustably controlling output of superheated vapor to provide propulsion.

25 Claims, 4 Drawing Sheets

SUPERHEATED VAPOR GENERATOR SYSTEM AND METHOD

FIELD OF THE INVENTION

The invention pertains to superheated vapor generators and systems for delivering superheated vapor flows as well as methods of fabrication and use of such superheated vapor generators and systems for providing desired flows of superheated vapor including substantially continuous flows.

DESCRIPTION OF THE PRIOR ART

Prior patents include U.S. Pat. No. 6,006,009 (the '009 patent), U.S. Pat. No. 5,471,556 (the '556 patent) and U.S. Pat. No. 4,414,037 (the '037 patent) owned by the inventor and applicant herein, co-pending U.S. patent application Ser. No. 08/484,019 owned by the applicant and inventor herein for Superheated Vapor Generator and Control System and Method, and co-pending U.S. Pat. Application No. 60/200,423 all incorporated by reference herein, references cited in connection with aforesaid U.S. Pat. No. 4,414,037 including U.S. Pat. Nos. 2,505,656; 2,753,212; 2,861,838; 2,983,450; 3,039,454; 3,218,741; 3,718,805 and 3,721,802, and patents cited in connection with said U.S. Pat. No. 5,471,556 including U.S. Pat. Nos. 377,228; 2,652,645; 3,436,852; 3,119,004; 3,869,815; 4,255,646; 3,508,354; 3,823,497; and 2,576,976.

The aforesaid references in the main refer to apparatus and methods for generating steam from liquid drawn from a reservoir.

The '037 patent discloses apparatus for generating superheated steam or other vapor from liquid drawn from a self-contained reservoir and includes means in the form of a nozzle for directing superheated steam or other vapor to desired locations. The '556 patent discloses improvements relative to the '037 patent. Said co-pending application discloses further improvements.

Equipment disclosed in the aforesaid patents and co-pending application is employable for effecting, among other things, cleaning and/or sterilization. This apparatus has proved highly useful for such purposes. In operation, such equipment provides flows of superheated vapor upon activation of a control member. Volume and pressure of such flows have been primarily determined by the volume and duration of the input flow of liquid supplied to the vapor generator and by the size of the outlet from the vapor generator.

In many applications, precision control of volume and/or pressure of output vapor would promote efficiency, economy and useability. In a particular case, for example, small or microminialurized equipment such as medical canulas, needles and the like, may be too fragile to withstand forceful streams of superheated cleaning vapor without danger of damage or breakage. Because of inability to perform proper cleaning of such vital and fragile devices many of them are discarded after one usage with an obvious substantial waste of resources.

Similar consideration apply to other small parts and components such as those in microelectronics, weapons, whose location, size or fragility may be such as to place severe limitations on the force of cleaning streams which can be applied without risk of damage.

Further applications for controlled emission superheated vapor output streams include propulsion among many others.

Therefore, there has been a felt but unfulfilled need for devices and methods providing superheated vapor generators having output whose output pressure and volume are controllable with substantial precision.

SUMMARY OF THE INVENTION

An improved superheated vapor generator defines an internal vaporizing chamber having input and output ports with means connectable to at least one of said ports to adjust and control input of liquid and output of superheated vapor.

A method for fabricating a superheated vapor generator in accordance with the invention includes the steps of providing at least two sections secureable together to define an enclosed interior space, and providing at least one adjustable valve member for at least input of liquid and output of superheated vapor, and further including the step of fastening said at least two sections together. The wall portion of the vaporization chamber may have any desired arbitrary surface configuration and in particular embodiments may be substantially smooth, etched, grooved, or including perforations of arbitrary cross-section or irregularities such as crack-like openings among other configurations in accordance with the invention.

A method of employing a superheated vapor generator system with controllable output includes adjusting the output for use for cleaning and sterilization including application to small, inaccessible, or fragile surfaces to be cleaned or sterilized and further includes adjustment such that output may be employed for propulsion among other applications.

DETAILED DESCRIPTION OF THE INVENTION

Figure 1:
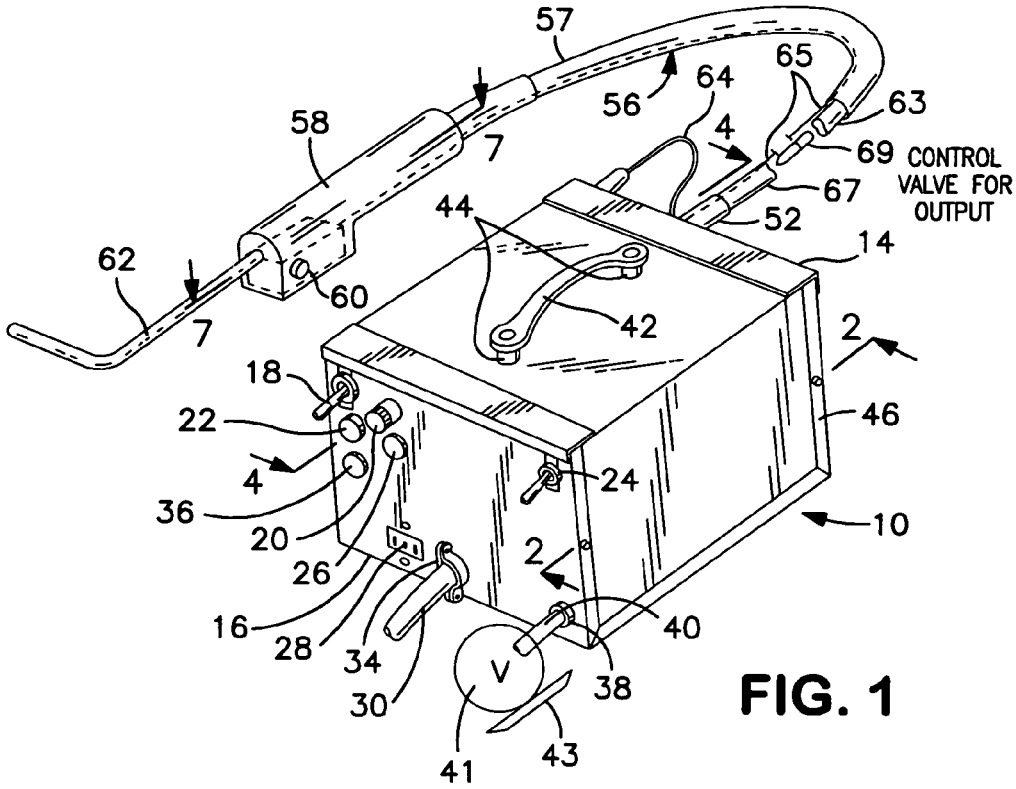
FIG. 1 is a perspective view of a system, partially simplified in accordance with the invention.
Figure 3:
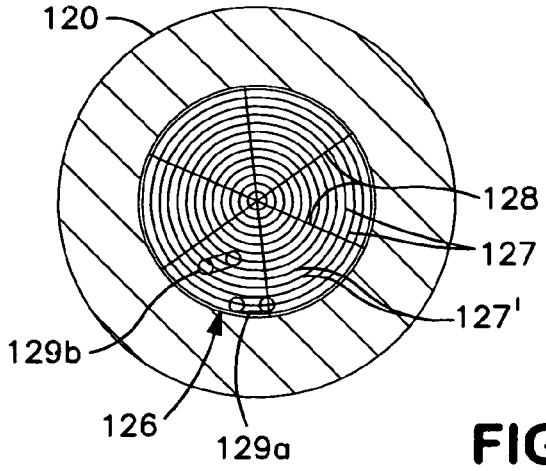
FIG. 3 is a section of a vapor generator member in accordance with the invention taken along the line 3-3 of FIG. 4.
Figure 2:
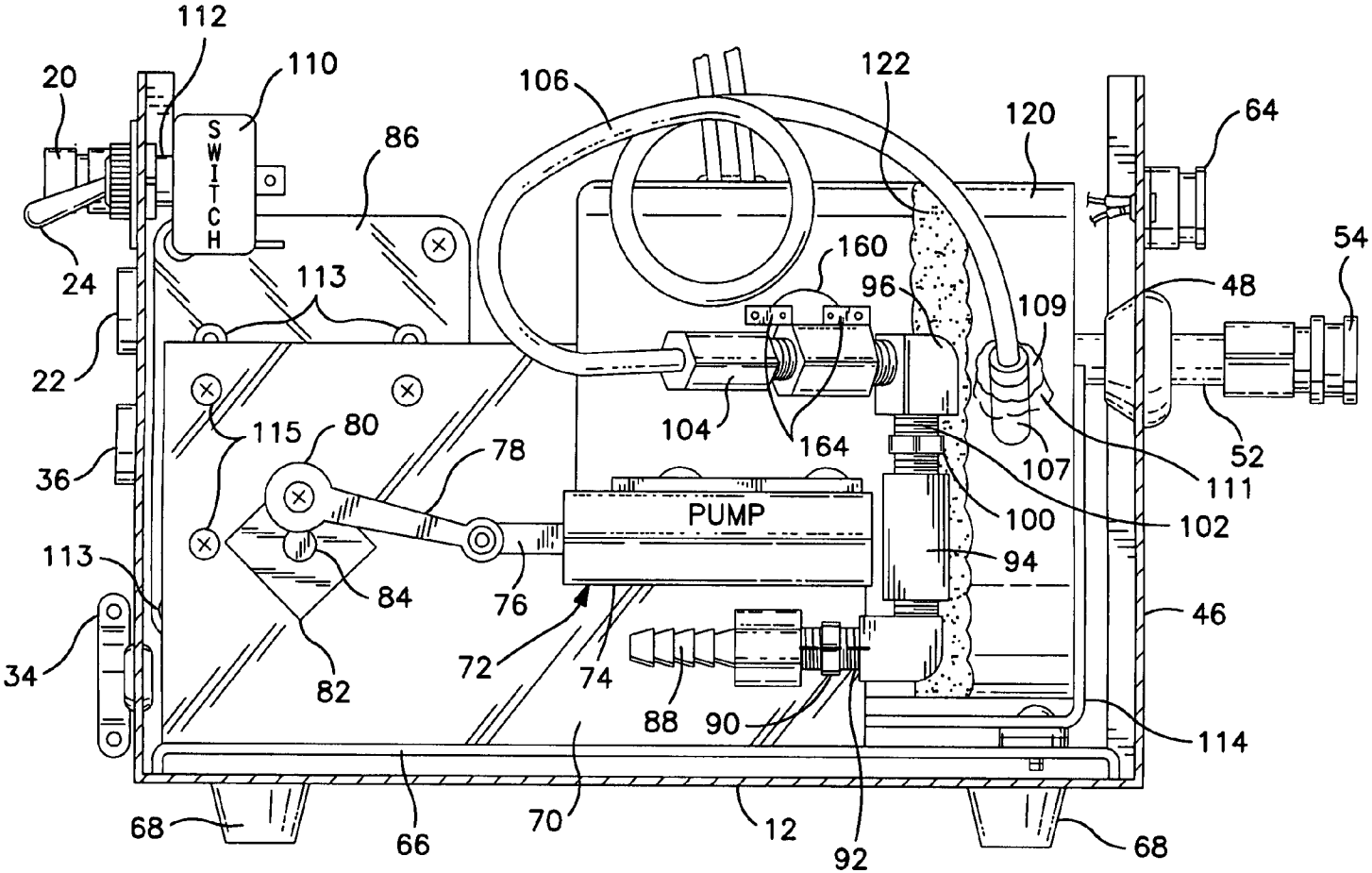
FIG. 2 is a section through the line 2-2 of FIG. 1.
Figure 4:
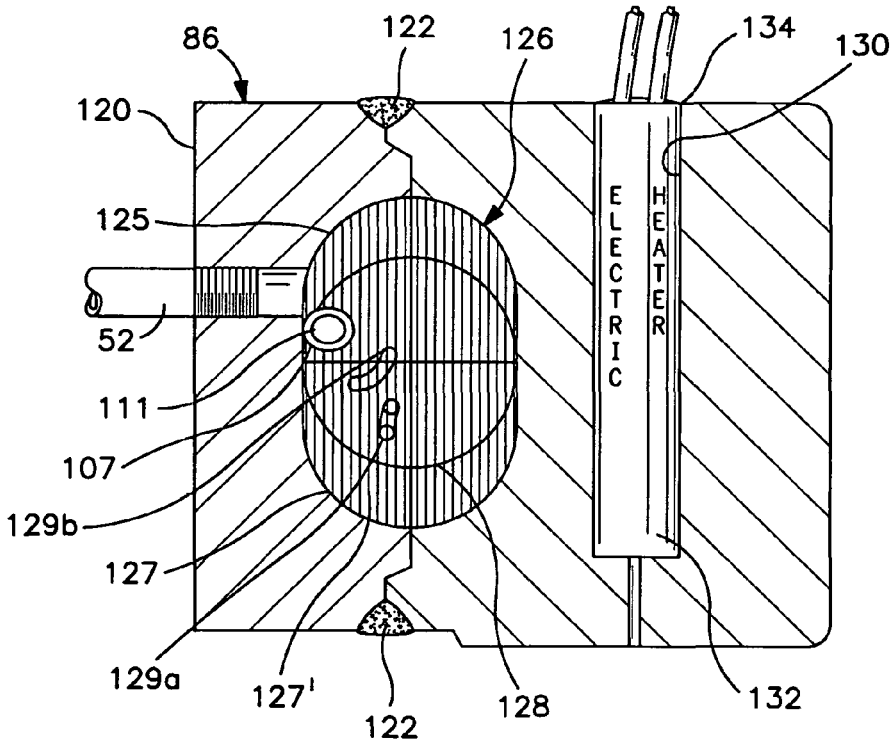
FIG. 4 is a sectional view taken along the line 4-4 of FIG. 1.

Referring to FIGS. 1-4, inclusive, a superheated vapor generator and control system 10 includes a base 12 forming the bottom of a housing 14. The housing 14 together with base 12 functions as a container for system 10. The top and sides of housing 14 are fastened to base 12 by conventional means and are removable to permit access to the interior of system 10. Details of particular aspects of system 10 are fully disclosed and described in the '556 patent incorporated by reference herein; thus, common features will be described in summary fashion herein.

Controls of system 10 are disposed upon a portion of housing 14 comprising a control panel 16 and a power switch 18, controlling drawing of power from an external source, i.e., whether the system 10 is "On" or "Off".

Disposed upon control panel 16 are a removable line fuse holder 20 and a white power light 22, to indicate power in system 10. Also disposed on control panel 16 is a manual vapor heating switch 24 for controlling the generation of steam and/or superheated vapor. An amber vapor generator light 26 is disposed on control panel 16 as an indicator of the operation of thermostatic regulation of a vapor generator.

A footswitch receptacle 28 is disposed in panel 16 and accommodates a foot switch (not shown) for controlling superheated vapor production. A power line 30 is accommodated in a fitting 32 attached to panel 16 around a slot 34 for passage therethrough of power line 30.

An amber heating chamber light 36 is positioned on panel 16 adjacent power light 22 and is electrically connected as described in the '556 patent to remain on while current is being drawn for heating. A liquid pick-up tube inlet 38 is defined in control panel 16 to receive a liquid pick-up tube 40. A fluid control valve 41 shown schematically is connected to tube 40. Valve 41 is of conventional type such as a ball-cock having a valve control 43 movable to adjust the flow of fluid therethrough. Valve 41 may be, as shown, disposed outside housing 14 or within housing 14 in accordance with the invention as depicted hereinbelow in connection with FIG. 2.

Valve 41 may be electronic as opposed to mechanical in accordance with the invention.

At the top of housing 14 is disposed a carrying handle 42 secured by fasteners 44 to housing 14. In a rear panel 46 of housing 14, an aperture 48 is defined; secured on both sides of aperture 48 is a gasket-type fitting 50. Aperture 48 and gasket 50 accommodate and receive a vapor exit pipe connector 52. A quick disconnect connector member 54 is disposed at an outer end of pipe 52 and is connectable to an outlet control member in the form of a directional control valve 63 (shown schematically) is connected with wand 56 and connector 54. Valve 63 defines a first exit port 65 and a second exit port 67 operable by a vapor control switch 69 a vapor control member or wand 56, the latter including a grip handle 58 in which is disposed a vapor control switch 59 operable by a vapor control push button 60. A tube 62 extends outwardly from control member handle 58. A vapor control power connector 64 is mounted in rear panel 46. A support plate 66 is fastened to base 12, which in turn rests upon feet 68.

A mounting plate 70 is fastened to support 66. Fastened to mounting plate 70 is a pump 72, which includes a cylinder 74 receiving a piston 76 reciprocating within cylinder 74. Piston 74 is pivotably connected to a rod 78 which with a pivoting member 80 at the opposite end of the rod forms pivotable connection between the rod 78 and piston 76. A substantially square cam 82 is pivotably attached to pivot member 80 and pivots and is rotatable on a shaft 84 mounted and pivotably journalled in plate 70.

An electric motor 86 is mounted upon mounting plate 70 and rotates shaft 84. Electric motor 86 is wired to withstand heat generated in system 10. Cam 82 is rotated by shaft 84, which in turn rotates on a sleeve in pivot member 80. An inlet fitting 88 accommodates inflow of liquid from inlet port 38 through inlet conduit 40. A first check valve 90 is connected to inlet fitting 88. As noted above, valve 41 may be connected to inlet fitting 88 as opposed to being connected to tube 40. Check valve 90 not only blocks backflow and prevents intake of solids into the apparatus but also affects the liquid content of superheated vapor produced by system 10.

A fitting 92 is connected to check valve 90 and accommodates flow of liquid therethrough to a T-fitting 94. T-fitting 94 is connected to the fluid intake inlet 88. Connected to T-fitting 94 is a second check valve 100 which in turn is connected to fitting 96. Check valve 100 is identical to check valve 90.

From fitting 96 fluid passes through a fitting 104 which is connectable to a tube 106, depicted as coiled for economy of space utilization. Tube 106 leads into a superheated vapor generator 120. A sleeve 107 is secured to tube 106 at its point of entry into generator 120. Sleeve 107 is preferably composed of aluminum and is welded to tube 106. Sleeve 107 preferably extends above the top surface of generator 120 and is secured to generator 120 at an exterior weld 109 and an interior weld 111.

A male connector 110 is fastened to a screw 112 mounted in panel 16 and connected to vapor switch 24. A bracket 114 fastened to plate 12 provides support and mounting for vapor generator 108.

Electric gear motor 86 is secured by a fastener 115 to mounting bracket 70. Electric gear motor 86 is of conventional type and drives pump 72 by means of cam 82 journalled on shaft 84 which in turn is driven by motor 86. A pair of buffer members 113 upon motor 106 are in contact with bracket 70 for the purpose of minimizing the effect of vibration upon the structure.

Vapor generator 120 comprises metal castings in two parts welded together at 122 defining a vaporization chamber 126. Generator 120 is detachably positioned within housing 14 and is secured thereto at bracket 114 as noted hereinabove, and rests on washers 124 between plate 66 and bracket 114. The bottom section of vapor generator 120 is longer to allow room for a heating element 132 described in full in the '556 patent. As depicted, chamber 126 is substantially spherical; however, other configurations may be employed in accordance with the invention. In the depicted configuration, the periphery of chamber 126 is referred to on occasion as a wall 125. In other configurations in accordance with the invention such periphery may comprise more than one wall.

The peripheral interior surface of wall 125 of chamber 126 is cut in a plurality of ridges and grooves 127, 127' respectively. The depth of the grooves 127' and the height of the ridges 127 are irregular, with the height and depth in a preferred embodiment varying substantially randomly between 0.0030-0.0050 inch. The ridges and grooves 127 are in the form of substantially concentric circles about an axis of generator 120.

In addition, cross-grain ridges and grooves are defined in wall 125 of chamber 126 and denoted by numerals 128, 128', respectively. Cross-grain ridges and grooves 128, 128' are, like the ridges and grooves 127, 127' of random and irregular dimensions. Ridges and grooves 128, 128' in the preferred embodiment vary randomly between 0.0020-0.0050 inch. It has been found that the groove and ridge configuration together with the irregularities in the depth of the grooves and the height of the ridges provides improved efficiency of vapor generation as, for example, more rapid vaporization with comparable or smaller energy consumption.

Disposed within chamber 126 are a plurality of thermal elements **129*a*, 129*b*. In the particular embodiment depicted and described, thermal elements 129*a*, 129*b* are shown as two in number, for purpose of specificity. In accordance with the invention the number of thermal elements may range from one (1) to whatever number may be desired. Thermal elements 129*a*, 129*b* may be but need not be in contact with surface 125. Thermal elements 129*a*, 129*b* may be but need not be attached to wall 125**.

Thermal elements **129*a*, 129*b* may be of arbitrary shape and size and are depicted as generally cylindrical and tubular for sake of particularity. Elements 129*a*, 129*b*** are composed of thermally conductive material.

Preferably, thermal elements **129*a*, 129*b* are composed of the same material as wall 125 of the interior of chamber 126. In this manner, electrolysis between thermal elements 129*a*, 129*b* on the one hand and interior surface of wall 125** on the other hand, is avoided.

To the extent that dissimilar metals can be mated without electrolysis such metals may be employed with advantage as, for example, stainless steel for surface 125 and aluminum for thermal elements 129*a*, 129*b*, and vice versa.

In accordance with the invention, the shape and surface of the interior surface of wall 125 of chamber 126 may be selected as appropriate for particular applications.

Defined in generator 120 is a receptacle 130 for receiving and accommodating a heating element cartridge 132. Alternatively, heating elements may be cast-in upon fabrication of the generator 120. Means for heating generator 120, such as heater band elements, solar power, or chemical, among others, may be employed in accordance with the invention. Heating cartridge 132 is affixed in receptacle 130 by means of cement of conventional type which is resistant to high temperatures. Receptacle 130 is open at both ends, traversing the length of generator 120. At a receiving end, receptacle 130 defines an aperture 134 which is dimensioned to receive cartridge 132. At its opposite end, receptacle 130 opens to an aperture 136 that is preferably smaller than aperture 134. Aperture 136 is dimensioned to accommodate a pin or tamping member (not shown) for thrusting through receptacle 130 to the base of cartridge 132 thereby ejecting cartridge 132 when desired. Thus, a spent or broken cartridge can be removed for repair or replacement in an economical, cost-efficient, and expeditious manner.

Heating cartridge 132 is of generally cylindrical configuration. Cartridge 132 defines an included volume 138 which contains a coil of resistance wire 140. An outer sheath 142 of heating cartridge 132 is fabricated of high temperature alloy of conventional type. One end of heating cartridge 132 is closed by end plate 144; adjoining the opposite end of heating cartridge 132 is a terminal block 146. Terminal block 146 comprises a bracket for supporting a pair of leads 150, 152. Leads, 150, 152 are enclosed in temperature insulation sheaths 154, 156, respectively. Sheaths 154, 156 may be of standard material such as high temperature fiberglass for the purpose of protecting against the elevated temperatures produced by heating cartridge 132. Heating cartridge 132 has a seal 158 substantially flush with the end of cartridge 142 and comprising thermally insulated material such as epoxy or cement.

The entire generator 120 is sheathed in insulated material such as fiberglass (not shown). The heat generated is such that the entire generator normally heats to 500° F. A first thermostat 160 is positioned in thermal contact with generator 120; thermostat 160 is preferably set to turn off at approximately 500° F., plus or minus ten percent (10%). Electrical terminals 164 accommodate wires (not shown) connecting to the electrical system of system 10 so as to turn off the power to the heating element 132 when the desired temperature is reached. Preferably thermostat 160 is flush mounted to the generator 120 as, for example, by screwing the thermostat into a slot together with conventional means (not shown) to prevent slippage of thermostat 160.

A second thermostat 166 is depicted as positioned approximately 90° along the circumference of generator 120 from first thermostat 160. Other positions, of course, may be employed in accordance with the invention. Second thermostat 166 is mounted in generator 120 and has a pair of electrical terminals 168 connectable to the electrical system of the apparatus. As fully described hereinbelow, second thermostat 166 is set to cut off current to the heating cartridge 132 in the event of failure of first thermostat 160 such that the temperature of the chamber 126 shall not exceed 550° F. Thermostatic control of generator temperature is described and depicted herein for specificity, such temperature control being capable of being carried out, for example, by such means as a circuit card connected to sensor apparatus such as a thermocouple, in accordance with the invention.

The electrical circuitry for control of system 10 is depicted and described in detail in the '556 patent. Power switch 18 controls the on/off condition of the entire system. Switch 24 is a manual vapor generator switch which as noted above is mounted on control panel 16. Wand switch 192 is actuated by push button 60 and like switch 24 controls vapor generation but is contained in the wand 56 for case of operation of the device. Switches 24, 192 control the on/off condition of pump motor 72. A terminal block 202 is fastened to base plate 12 and contains terminals 204 which provide electrical connections for the electrical circuitry of system 10.

A spark suppressor 206 is depicted as being connected with first thermostat 160 and second thermostat 166. The purpose of spark suppressor 206 is to prevent the respective thermostats from arcing. In the event that the spark suppressor 206 and the first thermostat 160 should fail, creating the danger of overheating and destruction of the unit, the second thermostat 166 at 550° F. will cut off. A thermofuse 207 cuts in upon failure of the second thermostat 166 and, will break the generator circuit at 650° F.

Red light 26 is connected to be on when the first thermostat 160 has cut out while the second thermostat 166 continues to operate, thus notifying the operator of a change in condition in the system.

White light 22 is illuminated when power switch 18 is closed (i.e., when the power switch is turned on). The amber light 36 is on when heating element 132 is drawing current. Light 36 remains on so long as heating element 132 draws current. When light 36 goes out, this indicates that generator 120 has reached its operating temperature. A foot jack switch control 208 is connected to and mounted upon foot switch receptacle 28 on panel 16 and performs the same function as switches 24, 192. Removable power line fuse 20 is depicted as in series with power switch 18. A relay arrangement may be employed to supply current to the heating element immediately upon actuation of any of the vapor control switches so as to maintain, in conjunction with the thermostats, a substantially constant power supply and temperature for vapor generation.

Heating cartridge 132 preferably delivers substantially 1000 watts of power to maintain temperature of the vapor generator 120 at 500° F. Other power delivery rates and operating temperatures, higher and lower, may be employed in accordance with the invention. The motor RPM is substantially equal to 366 and the pump delivery rate is preferably 4.9 gallons per hour. Other motor RPM and pump delivery rates may be employed in accordance with the invention.

In operation, system 10 is connected by hose 40 to source of liquid (not shown). The liquid may be any of a broad range related to the purposes for which the system 10 is to be used. In a typical cleaning context in which the system is employed to loosen and dissolve dirt as on machinery or circuit boards or in corners of a room, 100% undiluted water, distilled or deionized, may be employed. Additives such as detergents or disinfectants may be employed provided that they are stable at the operating temperatures of the system. The proportions of additives and water may be varied depending on the application. The solution may contain vaporizers, emulsifiers, degreasers, oxidants, alkalis, deodorizers, antiseptics, germicides, or the like. In addition, the liquid may comprise humidifiers, fresheners, and other reagents which the user may wish to impart to the air or to a surface or object.

Valve 41 is adjustable to control the intake of fluid into vapor generator 120. For particular applications, this intake may be increased or decreased depending on the volume, mass and pressure desired for the output of vapor generator 120.

For example, in connection with cleaning/sterilization of small fragile parts and components, such as medical canulas, needles and the like, the amount of fluid intake would be adjusted to supply an output flow of relatively small pressure and volume in order to avoid damage to the fragile parts under cleaning.

As a further example, substantial pressure and volume can be supplied at the output by adjusting valve 41 so that a relatively large volume of fluid will enter vapor generator 120. Such large output pressure and volume may be employed, for example, for propulsion of a motor, projectile or the like.

Particular applications of the system include cleaning of equipment, circuit boards and/or surfaces and spaces such as rooms in connection with maintenance or janitorial work. Valve 56 provides the capability for precise direction of the vapor flow even to small objectives and in particular allows impingement of the vapor into small, confined, or relatively inaccessible objects or spaces. Apparatus in accordance with the invention provides a general purpose cleaning capability with particular applicability to remote or relatively inaccessible areas, objects and small parts.

The invention may be employed in connection with burnishing or cleaning of small parts such as time-piece apparatus, in connection with metal plating, printing and photo-engraving, lapidary and stone cutting activity, manufacture and/or repair of electronic components, removal of such things as wallpaper, labels and the like, in connection with dry-cleaning, sanitizing and sterilizing of eating implements, in connection with optical and optometric laboratory and office work, with jewelry, dental and medical offices and operating theatres, miniature instrument manufacture and repair, and biological and analytic laboratories, among many other applications. Use of apparatus in accordance with the invention is particularly advantageous in that its flexibility permits cleaning of parts to be accomplished with a minimum of disassembly, degreasing and decontamination whereby cleaning is made environmentally compatible.

A particularly useful application of the invention is in connection with the cleaning and maintenance of military equipment, including weapons and related items. This has become timely in view of the current emphasis on repair and maintenance as opposed to acquisition of new items.

In particular applications, additional attachments such as a Luer lock fitting may be employed to adapt the device for directing superheated vapor at selected objectives—in the case of the Luer fitting—small medical devices such as canulas which are nested into the Luer fitting, as a preliminary to cleaning/sterilization.

The operator sets switch 62 to open a selected one of ports 58,60 facing toward the object to receive superheated vapor, which issues from the selected port, shown herein as port 60. Ports 58, 60 are depicted as arranged to direct output vapor in substantially perpendicular directions from to other, other numbers and arrangements of ports being employable in accordance with the invention. The superheated vapor such as steam, is "dry", i.e., having a high proportion of gas as opposed to content of fluid droplets. This has a favorable effect in that the amount of liquid included in the vapor is so small that the residue does not interfere with further cleaning and does not require a cleanup, the amount of fluid residue being so small that it can normally be readily removed by a cloth or paper towel. Pooling of liquid is virtually eliminated. The material removed by a towel in the form of a residue is easily disposed of, particularly in eases where any removed contaminants are non-hazardous or non-toxic.

Ports 58, 60 may function to provide pressure relief for each other, i.e., if pressure exceeds a desirable level at one port, the other may be opened to reduce the pressure acceptably. In accordance with the invention ports 58,60 and switch 62 may be connected so as to provide automatic pressure relief (i.e., a safety valve arrangement).

By use of the invention, the operator gains the capability of precisely directing relatively dry vapor to the object targeted. The invention produces a jet of superheated vapor of a temperature of approximately 500° F. at the nozzle.

Superheated vapor can be controlled to issue at a range of pressures from as low as a few atmospheres to relatively high pressure, approximately 120-200 and higher psi to at least 300+ psi and higher. As a result of this pressure range, the superheated vapor impringes upon, and into such relatively hard-to-reach spaces as portholes, crevices, and the like such pressure range being greater than available with prior devices as well as being employable for low-pressure applications as well as super-high pressure uses.

In addition, output of superheated vapor from ports 58,60 results in longer and higher-volume output streams. Application of heat causes contaminants to soften, liquefy, and generally decompose or disengage from the surfaces on which they are disposed. This applies to such normally hard-to-clean substances as grease, oil, grime, paste, glue, and carbon. For removal of tenacious contaminants, heat applied by the invention initiates cleaning. Then a cleaner or emulsifier may be applied in conventional fashion at which point a further flow of superheated vapor from the invention completes removal of the contaminant.

Other applications for the invention are, among others, lubrication, particularly of relatively inaccessible and small parts. Lubrication applied in this manner is a most effective type of hot lubrication in that the surface having been first cleaned by use of the invention in a cleaning mode, the lubricant can be applied by disposing lubricant on the now clean, heated parts by conventional means and then subjecting the parts to a flow of superheated vapor, causing the lubricant to be dispersed evenly throughout and upon the object to be lubricated.

Applications include cleaning of small parts such as micro-electronics, miniaturized components, weapons and the like.

Applications also comprise propulsion, including propulsion in various atmospheres and environments such as low-gravitational or non-gravitational as well as employment in conjunction with robotics in hostile (or non-hostile) environments.

The vapor output pressure control due to use of adjustable input affords greater flexibility and effectiveness for system 10. Output superheated vapor may be employed in a longer stream than previously feasible or with greater contact effectiveness at previous stream lengths, or a combination of these, as well as providing the capability of producing streams having greater widths and the like, much as in the variable stream patterns available with conventional garden hoses and nozzles.

Figure 5:
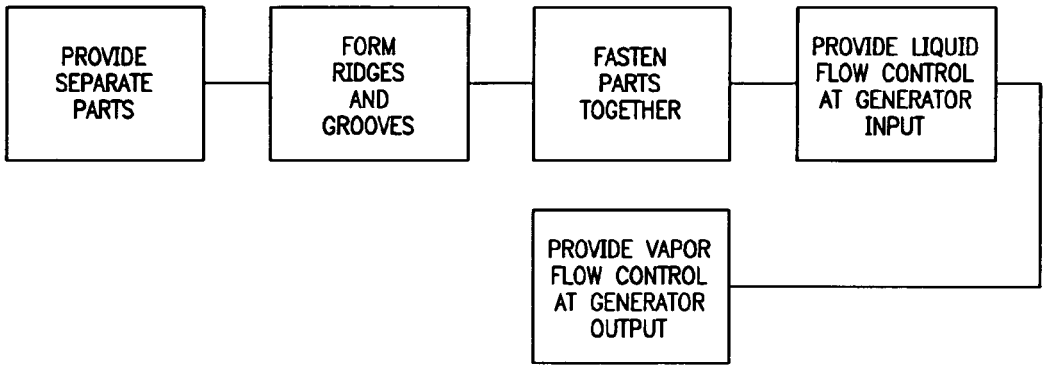
FIG. 5 is a schematic diagram of a method in accordance with the invention.

A method for fabricating superheated vapor generator system with a capacity of variable output pressure and volumes in accordance with the invention is depicted in FIG. 5. Two separate, preferably semi-cylindrical parts are provided. One part may have a longer axial extent than the other for purposes of accommodating a heating cartridge—or a cast-in heating element—and providing sufficient heat dissipative area to prevent undue heat and temperature build-up. The parts have hollow sections comprising the vaporization chamber.

As shown in FIG. 5 the hollow interior section of the parts may be either cast or machined to define a series of ridges and grooves of randomly varying heights and depths in a manner such that they are concentric or helical about the longitudinal axis of the part.

As shown in FIG. 5, radial grooves are then machined or cast in the parts such grooves also having varying depths and heights. The radial grooves may be 10-12 in number, and other quantities may be utilized as well in accordance with the invention. Full details of this procedure are specified in the '556 patent.

The parts are then welded together and may be fastened within a housing of a system in accordance with the invention. The completed superheated vapor generator is then coupled to a fluid pump with variable fluid flow at the generator input and at its output to a controlled valve for directing the superheated vapor.

Figure 6:
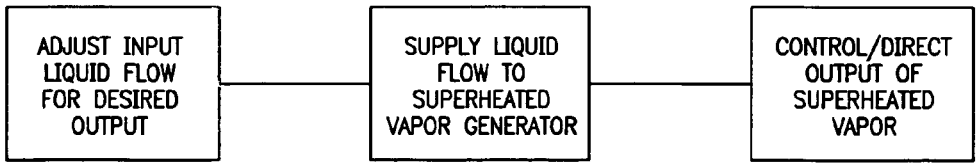
FIG. 6 is a schematic diagram of a method for employing the invention.

As depicted in FIG. 6, a superheated vapor generator system is employed to provide output flow of controlled and desired character. Input liquid flow is adjusted to produce desired pressure/volume output of superheated vapor. The output flow is controlled and directed by output control such as a valve.

There have therefore been provided an improved vapor generator and control system. Though a preferred embodiment has been described and depicted herein, the scope of the invention is defined by the claims to be filed pursuant to law and interpreted in light of the specification and drawings.

What is claimed is:

1. An improved vapor generator and control system comprising:

(1) a vaporization chamber for generating superheated vapor substantially instantaneously from liquid upon its entry therein, said vaporization chamber defining at least one input for input therethrough of liquid for vaporization in said vaporization chamber;

(2) liquid supply means connectible to said vaporization chamber for supplying liquid thereto through said input; and (3) adjustable control means for adjustably controlling ongoing input of liquid from said liquid supply means during ongoing input of said liquid from said liquid supply means into said vaporization chamber, adjustment of liquid input by said adjustable control means being substantially simultaneously reflected in adjustment of output of superheated vapor, whereby output of superheated vapor is highly precisely adjustably controllable while said system is in operation.

2. The invention as set forth in claim 1 wherein said adjustable control means adjustably controls volume of liquid input into said vaporization chamber and thereby adjustably controls volume of output of superheated vapor from said vaporization chamber.

3. The invention as set forth in claim 1 further including at least one output port for output therethrough of superheated vapor from said vaporization chamber, said at least one output port including means connectable to output control means for controlling output from said vaporization chamber.

4. The invention as set forth in claim 1 wherein said adjustable control means for adjustably controlling input of liquid into said vaporization chamber adjustably controls pressure of liquid input into said vaporization chamber and thereby adjustably controls pressure of output from said vaporization chamber.

5. The invention as set forth in claim 3 wherein said output control means controls volume of output from said vaporization chamber.

6. The invention as set forth in claim 3 wherein said output control means comprises at least one valve member.

7. The invention as set forth in claim 3 wherein said output control means includes means for directing in a selected direction superheated vapor from said vaporization chamber.

8. The invention as set forth in claim 7 wherein said output control means comprises at least one valve member.

9. The invention as set forth in claim 7 wherein said output control means is adjustable for directing superheated vapor from said vaporizing chamber in a plurality of selected directions.

10. The invention as set forth in claim 8 wherein said at least one valve member comprises a plurality of valve members at least two of which are adjustable to direct output superheated vapor in substantially perpendicular directions.

11. The invention as set forth in claim 3 wherein said output port is connectable to at least one object to which superheated vapor is to be directed.

12. The invention as set forth in claim 3 wherein said output control means is connectable to at least one object to which superheated vapor is to be directed.

13. The invention as set forth in claim 1 wherein said vaporization chamber has at least a portion of an inner surface which is rough.

14. The invention as set forth in claim 1 wherein said vaporization chamber has at least a portion of an inner surface which defines at least one groove.

15. The invention as set forth in claim 14 further including at least one groove other than the first-mentioned groove and wherein said first-mentioned groove and said second-mentioned groove intersect.

16. The invention as set forth in claim 1 wherein said vaporization chamber has at least a portion of an inner surface which defines a plurality of grooves.

17. The invention as set forth in claim 16 wherein said plurality of grooves vary substantially randomly in depth in a range substantially 0.030 inch to 0.050 inch.

18. The invention as set forth in claim 4 wherein said output control means is configured to be hand-held by an operator and to be controlled by said operator.

19. The invention as set forth in claim 1 wherein said vaporization chamber has at least a portion of an inner surface which includes at least one perforation.

20. The invention as set forth in claim 1 wherein said vaporization chamber has at least a portion of an inner surface which includes at least one irregularity.

21. A method of fabricating a superheated vapor generator and control system comprising the steps of:

(a) providing at least two separate parts of a vapor generator;

(b) fastening said parts together to form a superheated vapor generator defining a vaporization chamber, with at least one input thereto, said superheated vapor generator having capability for substantially instantaneous vaporization of liquid upon entry thereof into said vaporization chamber;

(c) providing liquid supply means connectible to said input of said vaporization chamber for supplying liquid thereto; and;

(d) providing adjustable control means for adjustably controlling ongoing input of liquid into said vaporization chamber during said ongoing input of liquid, adjustment of liquid input by said adjustable control means being substantially simultaneously reflected in adjustment of output of superheated vapor thereby providing the capability of highly precisely adjustably controlling output of superheated vapor from said vaporization chamber without requiring said system to cease operation.

22. The method as set forth in claim 21 further including the step of providing control means at the output of said vapor generator.

23. The method as set forth in claim 21 further including the step of defining at least one groove in at least a portion of an inner surface of at least one of said ports.

24. The invention as set forth in claim 21 further including the step of defining a plurality of grooves in at least a portion of an inner surface of at least one of said ports, such that said grooves vary in depth substantially randomly in height and depth in the range of 0.030 inch to 0.050 inch.

25. The invention as set forth in claim 22 wherein said output control means are adjustable to control the direction of superheated vapor from said vaporization chamber.

* * * * *